US006886831B2

(12) United States Patent
Tolany et al.

(10) Patent No.: US 6,886,831 B2
(45) Date of Patent: May 3, 2005

(54) GAME

(76) Inventors: William P. Tolany, 10903 Sierra Colorado, Austin, TX (US) 78759; Virginia Dukes Tolany, 10903 Sierra Colorado, Austin, TX (US) 78759

( * ) Notice: Subject to any disclaimer, the term of this patent is extended or adjusted under 35 U.S.C. 154(b) by 75 days.

(21) Appl. No.: 10/242,178

(22) Filed: Sep. 12, 2002

(65) Prior Publication Data

US 2004/0051250 A1 Mar. 18, 2004

(51) Int. Cl.[7] ..... A63F 3/00
(52) U.S. Cl. ..... 273/429; 273/431
(58) Field of Search ..... 273/274, 429, 273/430, 431

(56) References Cited

U.S. PATENT DOCUMENTS 4,907,808 A 3/1990 Turner et al.
4,998,735 A 3/1991 Blackwell, III
5,121,928 A 6/1992 Salerno-Sonneberg
5,145,184 A 9/1992 Yearick et al.
5,472,207 A 12/1995 Sullivan, Jr. et al.
5,607,160 A 3/1997 Stevens
5,660,389 A 8/1997 Freda, III
5,906,371 A 5/1999 Peterson
6,267,376 B1 7/2001 Jenkins
6,279,909 B1 8/2001 Alexander, II et al.

*Primary Examiner*—William M. Pierce
(74) *Attorney, Agent, or Firm*—Peter V. Schroeder

(57) ABSTRACT

A game includes a game board 10 marked with a plurality of indicia 40*a*–40*b*, 41*a*–41*b*, 42*a*–42*e*, 43, and 44. The game also includes a plurality of markers 30*a*–30*f* for positioning on indicia of the playing surface. A deck of question cards 20 including a plurality of question cards 21 is included, with each card bearing instructions 52, a question 53, and answers 54. The questions are designed to test various skills. A deck of bidding cards 22 is also included, with each card bearing the relative value of the bid 60 and relevant instructions 61. Successful identification of the answers on the question cards determines advancement of a player's marker on the game playing surface commensurate with the bidding card played, marker location on indicia 41–44, and the success of other players on the same question card.

19 Claims, 1 Drawing Sheet

GAME

BACKGROUND OF THE INVENTION

The present invention relates generally to a game and, more particularly, to a game testing various skills, and involving self-assessment and competitive strategic assessment.

Most previous games have focused on testing teams or players on skills in alternating turns. Successful demonstration of the skill generally allows for advancement in the game. The games themselves test a wide variety of skills, including factual knowledge, various communication abilities, or some additional skill or combination of skills.

Though these games involving alternating turns have been successful, they do have limitations. One considerable limitation is that the majority of players are inactive during a majority of the game playing time. This high degree of inactivity during the turns of competing players reduces the appeal of such games to a large portion of their potential audience.

While some games do attempt to rectify this limitation of inactivity by allowing multiple player and team participation on an individual turn, they too have difficulties. The participants of these games have little control over their potential reward for successful demonstration of a skill. These versions tend to require skills of perceived varying difficulty, or to reward the first individual or team to perform a particular skill to the exclusion of rewarding other participants. These games are thus enjoyed less by those whose requisite skill set is not as great as those of other competitors, by those with comparable skill sets but who tend to respond less quickly, and by those whose perception of the skill difficulty differs from that of the games' creators. This diminished enjoyment reduces the appeal of such games to a considerable segment of their potential audience.

An additional drawback of existing games is their static game play. Those demonstrating superiority in the required skill or skills of the game tend to lead the progression of the game throughout its play until an inevitable conclusion. Though some games do introduce a degree of variability through dice or some other randomized mechanism, players with an inferior skill set according to the game must rely on chance and an unlikely random set of occurrences to be competitive at any point during the play of the game. This static environment and complete reliance on chance limits the appeal of the games to a significant portion of their potential audience.

Hence, there is a need for a game which creates continuous involvement for all players, allows players to control their potential risk and reward depending on their comfort level with a particular skill, and offers a dynamic environment where facility can vary depending on strategic and interactive play beyond the successful demonstration of preordained skills. This present invention directly addresses this need.

SUMMARY OF THE INVENTION

In accordance with the present invention, a game kit is described. The game kit includes a game playing surface marked with a plurality of indicia, a plurality of markers for positioning on the indicia of the game playing surface, a deck of question cards, and a deck of bidding cards. Each question card includes a plurality of answers, and each question card bears instructions for a player to solicit responses from all other players to a shared group question. Each bidding card bears a relative value of the bid that controls both the level of difficulty in responding to a shared group question and the reward for responding correctly to the question.

Successful demonstration of the skill, selected bidding cards, the performance of competing players, and marker location on a plurality of indicia on the game playing surface all combine to determine the advancement of a marker on the game playing surface.

The current invention possesses multiple advantages over other presently available games. Since the current invention involves each participant on each test of skill, it is more entertaining and involving to a larger group of players, particularly those for whom other games are marred by a high degree of relative inactivity. The game of the current invention also allows participants to adjust the risk and reward of their skill performance based on their own comfort level with a particular skill, while still guaranteeing them an opportunity to perform the skill. This is an advantage over other games which either offer no risk and reward monitoring, allow only one successful participant on any individual skill request, or arbitrarily vary the perceived difficulty of the individual skill request across participants. A final advantage of the current invention is in its dynamic game play, where strategic play and interactivity with the performance of other participants avoid the drawbacks of other games which are often foregone conclusions or left solely to chance. Therefore, the game of the current invention is more entertaining, involving, dynamic, and appeals to a wider selection of potential participants than those games currently available.

BRIEF DESCRIPTION OF THE DRAWINGS

The understanding of the aforementioned elements and many of the inherent advantages of this current invention will be strengthened by the following detailed description and associated figures, where.

DETAILED DESCRIPTION OF THE PREFERRED EMBODIMENT

Figure 1:
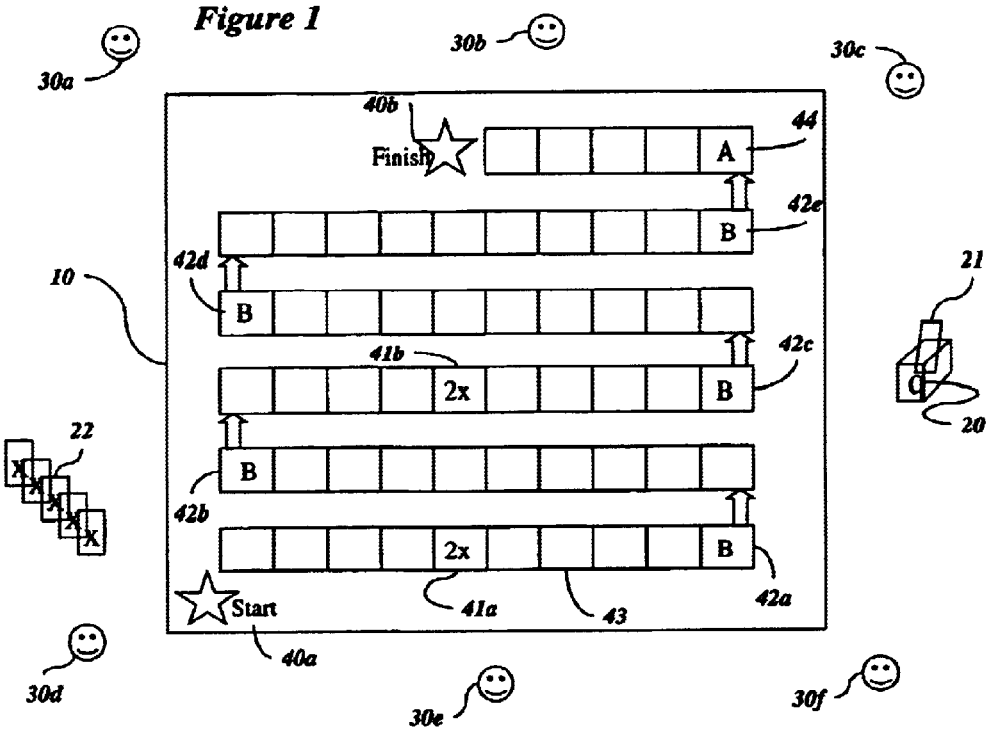
FIG. 1 is a total view of the game in accordance with the current invention.

FIG. 1 illustrates a preferred embodiment of a game devised to conform with the current invention. The game includes a playing surface 10, a deck of question cards 21, a deck of bidding cards 22, and a plurality of markers 30*a*–30*f* for tracking a player's progression through the game. The playing surface 10 is illustrated as it would be set up on a table top, floor, or other level surface. Although the preferred embodiment illustrated of the game is a board game, the game of the current invention may also be configured in a computer-based playing environment.

The playing surface 10 is made from a rigid material such as cardboard. It has a start position 40*a* and a finish position 40*b*, with the two ends connected by multiple spaces including 41*a*–41*b*. 42*a*–42*e*, 43, and 44. Players or teams of players progress through these spaces as outlined below. For alternate embodiments of the game, the playing surface may be a computer graphical user interface, or may be alternately arranged to track a player's progression through the successful demonstration of skills.

The spaces 41*a* and 41*b* allow for an accelerated progression through the game board contingent upon a successful demonstration of skills. The spaces 42*a*, 42*b*, 42*c*, 42*d*, and 42*e* allow for an accelerated progression through the game board contingent upon bidding strategy and a successful demonstration of skills. The space 43 offers a normal progression through the game board. The space 44 potentially retards a player's progression through the game board. As a non-limiting example, and as seen in FIG. 1, spaces 41*a*–41*b* double a player's score on an individual round, spaces 42*a*–42*e* add a fixed number of spaces to a player's score on an individual round contingent upon a particular bid, and space 44 reverses a player's progression contingent upon a particular result for that round. Additional embodiments may utilize other progression accelerators or decelerators throughout the playing surface 10. The presence of these accelerating and decelerating spaces are preferred because they add additional elements of strategy and dynamism to the game play.

Figure 2:
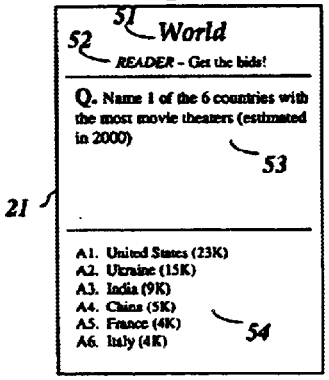
FIG. 2 is a front view of a representative question card including a keyword, a question, a plurality of answers, and instructions for a player to solicit responses to a shared group question.
Figure 3:
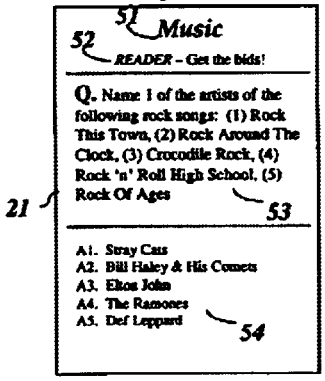
FIG. 3 is a front view of an additional question card including a keyword, a question, a plurality of answers, and instructions for a player to solicit responses to a shared group question.
Figure 4:
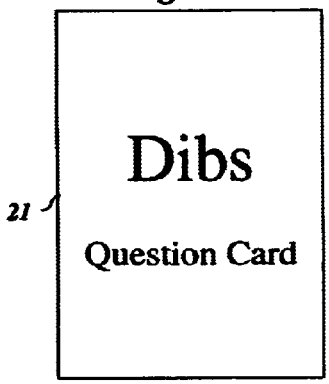
FIG. 4 is a back view of the question cards shown in FIGS. 2–3.

Please refer to FIG. 2, FIG. 3, and FIG. 4 for a detailed illustration of question cards 21. Each question card 21 tests different skills of competing players. FIG. 2 shows a sample question card 21 containing a single question 53 with multiple correct answers 54. The card also contains instructions 52 for the question's reader, and a keyword 51 to guide the bidding of individual players or teams. The sample instruction from FIG. 2 is "get the bids". The sample question from FIG. 2 is "Name 1 of the 6 countries with the most movie theaters (estimated in 2000)", and the sample answers from FIG. 2 are "United States, Ukraine, India, China, France, Italy". Individual players respond in a sequence set by their respective bidding cards and position on the board, and questions like the one in FIG. 2 test the ability of players to answer wide-ranging questions without any prompting data.

FIG. 3 shows a sample question card 21 of a different type from that in FIG. 2. This question card also contains a keyword 51, single question 53 and multiple correct answers 54, but the question type in FIG. 3 also contains prompting data for the respondents. The sample card from FIG. 3 contains identical instructions 52 as those in FIG. 2. The sample question from FIG. 3 is "name 1 of the artists of the following rock songs: 1. Rock This Town, 2. Rock Around The Clock, 3. Crocodile Rock, 4. Rock 'n' Roll High School, 5. Rock Of Ages," and the sample answers from FIG. 3 are "Stray Cats, Bill Haley & His Comets, Elton John, The Ramones, and Def Leppard." As with the type of question shown in FIG. 2, the type of question in FIG. 3 has individual players respond in a sequence set by their respective bidding cards and position on the board. Questions like the one in FIG. 3 test the ability of players to answer wide-ranging questions with direct prompting data, which requires different abilities than those of the questions detailed in FIG. 2.

Figure 5:
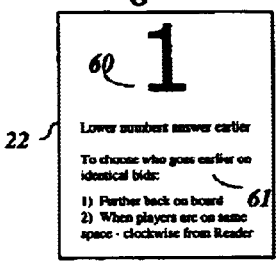
FIG. 5 is a front view of a representative bidding card including a relative value of the bid that controls both the level of difficulty in responding to a shared group question and the reward for responding correctly to the question.
Figure 6:
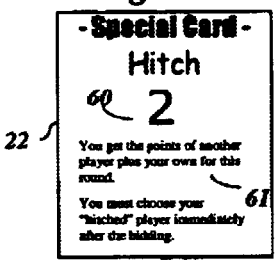
FIG. 6 is a front view of a representative bidding card including a relative value of the bid that controls the level of difficulty in responding to a shared group question, the reward for responding correctly to the question, and unique instructions relevant to the individual bidding card.
Figure 7:
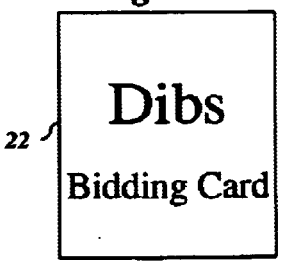
FIG. 7 is a back view of the bidding cards shown in FIGS. 5–6.

Please refer to FIG. 5, FIG. 6, and FIG. 7 for a detailed illustration of bidding cards 22. The bidding cards 22 represent a means for players to adjust the risk and reward of their skill performance based on their own comfort level with a particular skill. Individual bidding cards contain instructions 61 and different values 60, each of which adjusts the difficulty in demonstrating a skill and the accompanying progression through the game board. Each bidding card played is gauged in relation to the bidding cards of other players for that round, and used along with the successful demonstration of a skill, the responses of competing players, any relevant special instructions on the bidding cards, and the aforementioned accelerating and decelerating spaces to determine a player's progression through the game board.

In summary, the game of the current invention includes multiple bidding cards 22 which adjust the risk and reward of responding to particular questions 53 on question cards 21 testing different skills of competing players. Successful demonstration of the skill, selected bidding cards, the performance of competing players, and marker location on a plurality of indicia 41–44 on the game playing surface all combine to determine the advancement of a marker on the game playing surface.

The method of game play may be best understood by referring to FIGS. 1–7. To play the game of the current invention, there must be three or more players. Individuals may combine to form one team. The game has question cards 21 which test varying skills, and bidding cards 22 which serve as an indicator of a player's confidence in his or her own ability to perform said skills. The object of the game is to move from the start space 40*a* to the finish space 40*b* via the game board 10 faster than other competitors.

To play the game, one individual selects a question card 21 from the question deck 20 and reads the keyword 51, then solicits bids from all other players. All other players select a bidding card, 22 based on their confidence in their ability to correctly perform the required skill, the relative position of all markers 30*a*–30*f* on the game board 10, and any spaces 41*a*–41*b*, 42*a* 42 *e*, 43, and 44 that may affect the question's outcome. After all bids are completed, the individual with the question card 21 reads the question 53, and solicits responses from all other players in a sequence based on their bids.

Each player moves around the game board 10 by providing correct answers 54. The pace of the player's progression is determined by the bidding card 22 played, and can be increased or decreased by the success of other players on the same question or by the aforementioned unique spaces. The game ends and a winner is declared when one player reaches the finish space 40*b*.

The current invention possesses multiple advantages over other presently available games. Since the current invention involves each participant on each test of skill, it is more entertaining and involving to a larger group of players, particularly those for whom other games are marred by a high degree of relative inactivity. The game of the current invention also allows participants to adjust the risk and reward of their skill performance based on their own comfort level with a particular skill, while still guaranteeing them an opportunity to perform the skill. This is an advantage over other games which either offer no risk and reward monitoring, allow only one successful participant on any individual skill request, or arbitrarily vary the perceived difficulty of the individual skill request across participants. A final advantage of the current invention is in its dynamic game play, where strategic play and interactivity with the performance of other players avoid the drawbacks of other games which are often foregone conclusions or left solely to chance. Therefore, the game of the current invention is more involving, entertaining, strategic, and dynamic, and appeals to a wider selection of potential participants than those games currently available.

From the previous description, it may be seen that a game devised to conform with the current invention incorporates many original components and considerable advantages over those currently available. While the current preferred embodiment of the invention has been illustrated and described, it is to be understood that within the scope of the appended claims, various changes can be made therein without the departing from the scope of the invention.

What is claimed is:

1. A game kit entailing:

a) a game playing surface marked with a plurality of indicia, the indicia on the game playing surface including game progression indicia whereby a user may track the progress of a plurality of players through the game;

b) a plurality of markers for positioning on indicia of the game playing surface;

c) a plurality of question cards to test various skills, each card bearing a question and multiple correct answers to the question, each card allowing differing and correct responses from a plurality of players to the question; and d) a plurality of bidding cards, each card bearing a relative value of a bid for responding to the question cards, the bidding cards for determining a sequence of response by the players to a question card.

2. The game kit of claim 1, wherein the plurality of indicia include a sequence of spaces having a start position and a finish position connected by multiple spaces.

3. The game kit of claim 2, wherein each question card bears prompting information.

4. The game kit of claim 1, where the question cards include an identifying keyword.

5. The game kit of claim 1, where the the questions cards bear instructional information for a reader of the card.

6. A game kit entailing:

(a) a game playing surface marked with a plurality of indicia;

(b) a plurality of markers for positioning on indicia of the same playing surface;

(c) a plurality of question cards, each card bearing a question and answers to rest various skills;

(d) a plurality of bidding cards, each card bearing a relative value of a bid for responding to the question cards, where the indicia on the game playing surface designate the player's progression through the game as a result of a chosen bidding card.

7. The game kit of claim 1, where the game playing surface comprises a rigid board.

8. The game kit of claim 1, where the game entails a computer based playing environment or an electronic playing environment.

9. The method of game play for a plurality of players, comprising:

a) selecting one of a plurality of question cards, each question card bearing instructions for use, a question, and a plurality of correct answers to the question;

b) selecting a plurality of bidding cards, each bidding card bearing a relative bid value bid;

c) responding to the question contained on the question card by a plurality of players in a sequence determined by the bid values of the selected bidding cards, and d) tracking progression of the plurality of players in the game by use of markers on a game board.

10. The method of claim 9, where the step of selecting a bidding card further comprises assigning a potential risk and reward to a player far responding to the questions contained on the question card.

11. The method of claim 10, further comprising administering the question and plurality of correct answers on the question card.

12. The method of claim 11, wherein the step of responding further comprises a plurality of players responding in an order determined by the selected bidding card.

13. The method of claim 12, where the progression of each player is determined by the selecting of a bidding card, and the responding to the question contained on the question card.

14. The method of claim 13, further comprising giving advantages to selected players.

15. The method of claim 11, the step of administering performed by one of the players, the step of responding further comprising each of the remaining plurality of players responding to the question contained on the question card.

16. A method of game play for a plurality of players, comprising the following steps:

a player administering a question card, the question card having a question and a plurality of correct answers thereon, by presenting the question on the card to the other players and soliciting answers from the other players;

the other players each selecting a bidding card, each bidding card bearing a relative bid value;

the other players providing a response to the question on the selected question card in a sequence determined by the selected bidding cards; and progressing a player along a game board, the movement of a player related to the response provided by the player and the bidding card selected by the player.

17. The method of claim 16 wherein the step of providing a response in a sequence further includes the step of using the responses of other players to determine a player's progression along a game board.

18. The method of claim 16 wherein the step of progressing a player along a same board further comprises progressing or regressing the player along a game board.

19. The method of claim 16 wherein one or more of the steps is accomplished through use of a computer.

* * * * *

UNITED STATES PATENT AND TRADEMARK OFFICE

CERTIFICATE OF CORRECTION

PATENT NO. : 6,886,831 B2
DATED : May 3, 2005
INVENTOR(S) : William P. Tolany et al.

It is certified that error appears in the above-identified patent and that said Letters Patent is hereby corrected as shown below:

Column 5,
Line 53, "rest" should read -- test --.

Column 6,
Line 8, the second occurence of the word "bid" should be ommitted. The phrase should read: -- b) selecting a plurality of bidding cards, each bidding card bearing a relative bid value. --.
Line 17, "far" should read -- for --.

Signed and Sealed this

Sixteenth Day of August, 2005

JON W. DUDAS
*Director of the United States Patent and Trademark Office*